US005795204A

United States Patent [19]

Bruner

[11] Patent Number: 5,795,204

[45] Date of Patent: Aug. 18, 1998

[54] COMBINATION WATER SHOE AND SWIM FIN

[76] Inventor: Roderick S. Bruner, 452 Brandt Ct. #10, Salt Lake City, Utah 84107

[21] Appl. No.: 847,161

[22] Filed: Apr. 30, 1997

[51] Int. Cl.[6] ..... A63B 31/11

[52] U.S. Cl. ..... 441/61; 441/64

[58] Field of Search ..... 441/61, 64, 62, 441/63; D21/239; 36/8.1, 114

[56] References Cited

U.S. PATENT DOCUMENTS

| | | | |
|---|---|---|---|
| D. 264,394 | 5/1982 | Hlustik | D2/312 |
| D. 342,145 | 12/1993 | Yeh | D2/903 |
| 895,451 | 8/1908 | Gorham | 441/61 |
| 3,471,948 | 10/1969 | Nadler | 36/11 |
| 4,481,725 | 11/1984 | Bergmans | 36/11 |
| 5,181,873 | 1/1993 | Tolbert | 441/65 |
| 5,266,062 | 11/1993 | Runckel | 36/8.1 |
| 5,356,323 | 10/1994 | Evans | 441/64 |

*Primary Examiner*—Sheaman Basinger
*Attorney, Agent, or Firm*—John D. Gugliotta

[57] ABSTRACT

A combination water shoe and swim fin is provided offering foot protection on land or in water. A pliable sole having a slip resistant lower surface is formed to a shoe upper body formed of mesh material allowing for quick water drainage from the inner foot receiving cavity formed between the sole and upper body. Extending from the sole outward from the outer shoe sidewall is a swim fin. The swim fin extends laterally outward, and does not extend forward beyond the toe fence of the shoe.

9 Claims, 5 Drawing Sheets

COMBINATION WATER SHOE AND SWIM FIN

BACKGROUND OF THE INVENTION

1. Field of the Invention

The present invention relates generally to aquatic footwear and, more particularly, to a water shoe uniquely adapted to function as foot protection both under and out of the water.

2. Description of the Related Art

As is well-known in the art, many types of footwear are known and have been employed for thousands of years. A development that in recent years has been commercially deployed is a water shoe capable of providing foot protection in a wet environment. To best illustrate this phenomena, in U.S. Pat. No. Des. 342,145, issued in the name of Yeh, a water moccasin is depicted embodying some features common to such water shoes. As shown, a sole with slip resistant lower surface is attached to an upper surface that allows for the relatively free drainage of water that may make its way into the interior of the shoe. A material of construction common for this upper surface is a nylon or other synthetic mesh material.

Also well known in the art are swim fins of the type used by divers, swimmers, or snorkelers. Although such swim fins are in common usage, a particularly improved adaptation of such fins is shown in U.S. Pat. No. 5,356,323, issued in the name of Evans. The purpose of such swim fins is to improve the translation of the swimmer's foot paddling into forward locomotion through the water. This is generally accomplished through the use of increased surface area in a manner that is resistant to water penetration.

Although both water shoes and water fins are known, the combination of the two remains unknown. Generally, water fins require additional surface area, and thereby include features that extend outward from the front of the user's foot, or in combination with added width. Such features necessarily would hinder the act of walking, causing a user to either trip or walk in an unnatural, exaggerated manner in order for the fin not to catch against the ground. Further, to date, water shoes have not been known to include features that would primarily allow for improved swimming capabilities. Consequently, a need has been felt for providing an apparatus that would provide foot protection from hot sand, sharp rocks, and coral, while at the same time allowing for faster, easier swimming in the water, while at the same time allowing for normal walking and running on land.

SUMMARY OF THE INVENTION

It is therefore an object of the present invention to provide an improved recreational shoe.

It is another object of the present invention to provide an improved recreational shoe capable of quickly draining water therefrom.

It is yet another object of the present invention to provide an improved swimmer's fin capable of allowing the user to walk conventionally outside of an aquatic environment in a normal, comfortable manner.

It is a feature of the present invention to provide an improved water shoe that includes a swim fin extending therefrom, thereby allowing for otherwise conventional land use AND otherwise conventional water use.

Briefly described according to one embodiment of the present invention, a combination water shoe and swim fin is disclosed that offers foot protection on land or in water. A pliable sole having a slip resistant lower surface is affixed to a shoe upper body formed of mesh material allowing for quick water drainage from the inner foot receiving cavity formed between the sole and upper body. Extending from the sole outward from the outer shoe sidewall is a swim fin. The swim fin extends laterally outward, and does not extend forward beyond the toe fence of the shoe. The swim fin tapers laterally inward toward the shoe sidewall at the heel, and has a semi-rigid outer edge. The outer fin edge is fairly stiff and thick at the heel portion, and tapers in thickness and becomes progressively more flexible toward the toe portion. A fin area is formed between the outer fin edge and the shoe outer sidewall. This fin area forms a water flow channel between the outer fin edge and outer shoe sidewall to allow for improved water drainage away from the shoe.

An advantage of the present invention is that it can provide foot protection at the beach or other wet areas without accumulating water within the shoe.

Another advantage of the present invention is that it can provide foot protection in aquatic environments. Further, the preferred embodiment of the present invention can provide a swimmer or diver with an improved swimming ability of the type similarly provided by conventional swimmer's fins.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
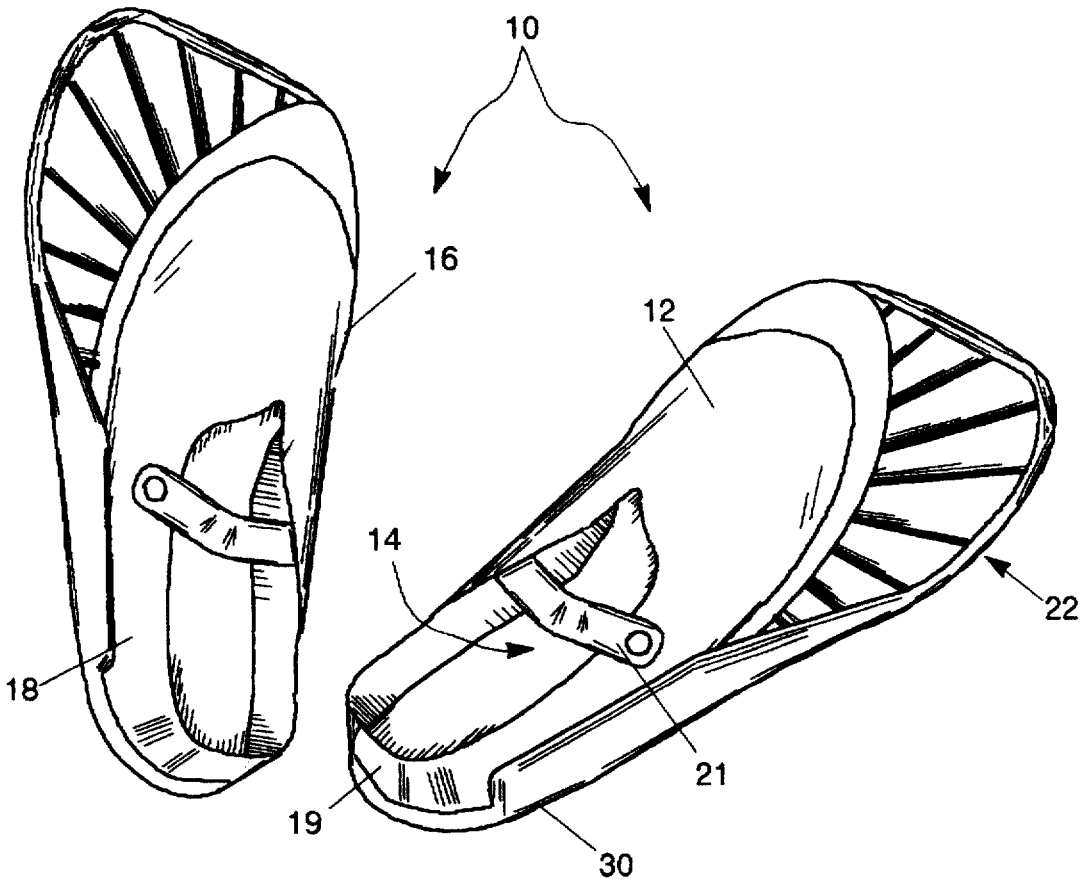
FIG. 1 is a perspective view of a pair of combination water shoe and swim fins according to the preferred embodiment of the present invention.
Figure 2:
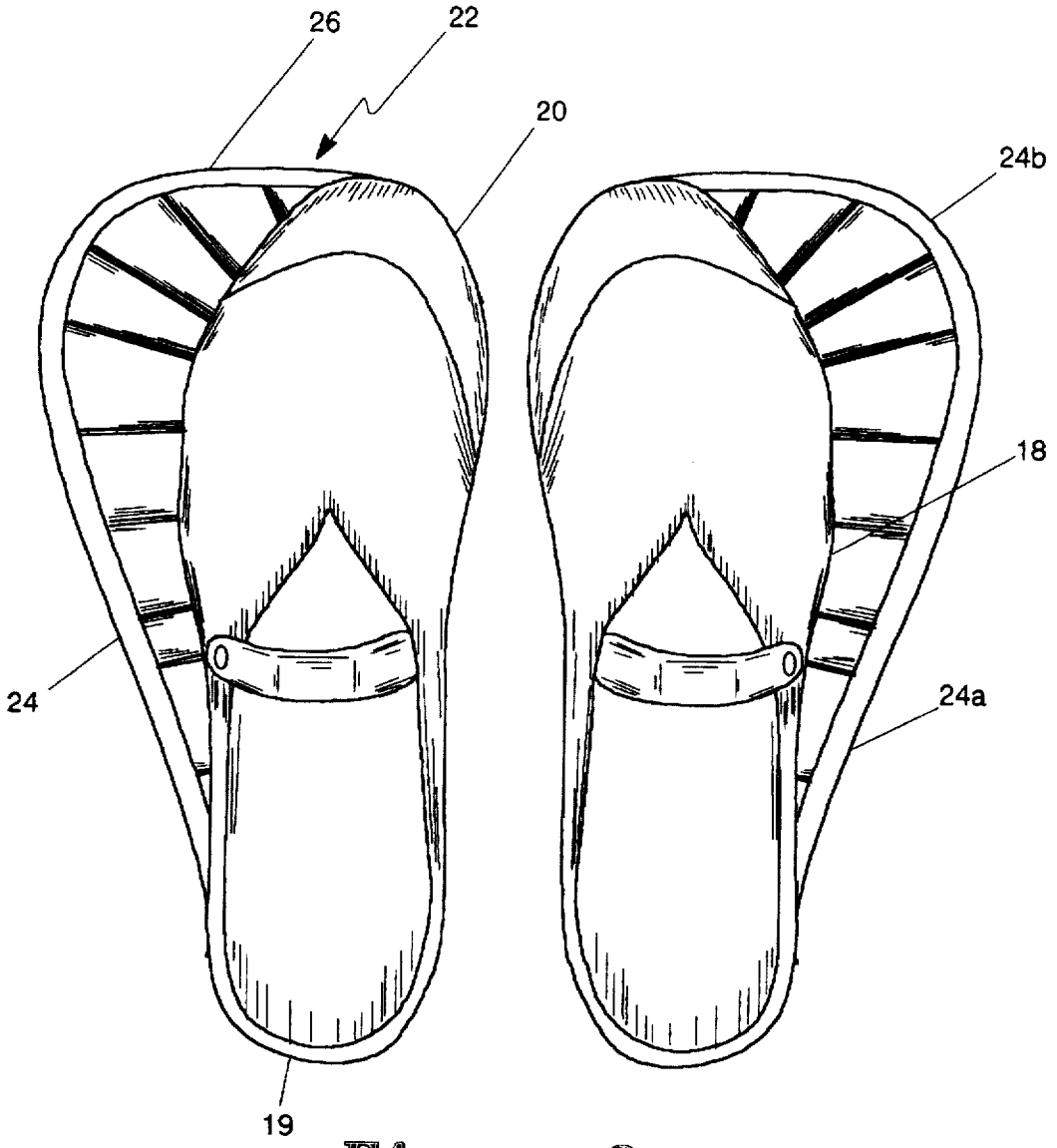
FIG. 2 is a top plan view thereof.
Figure 3:
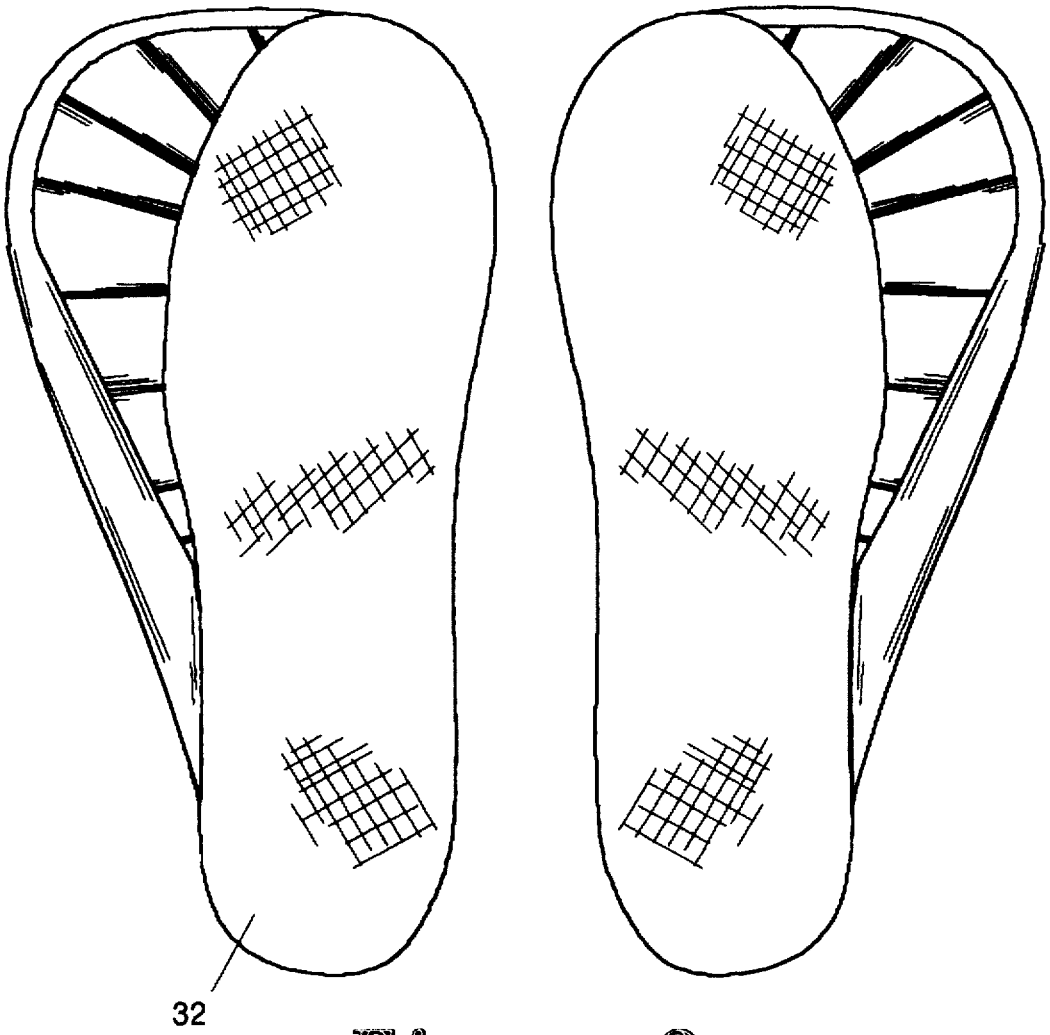
FIG. 3 is a bottom plan view thereof.
Figure 4A:
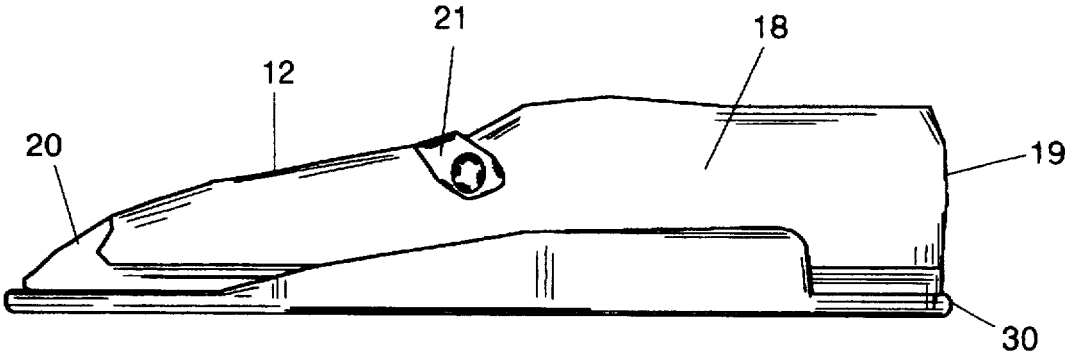
FIG. 4*a* is an outside elevational view of a combination water shoe and swim fin as depicted in FIGS. 1–3.
Figure 4B:
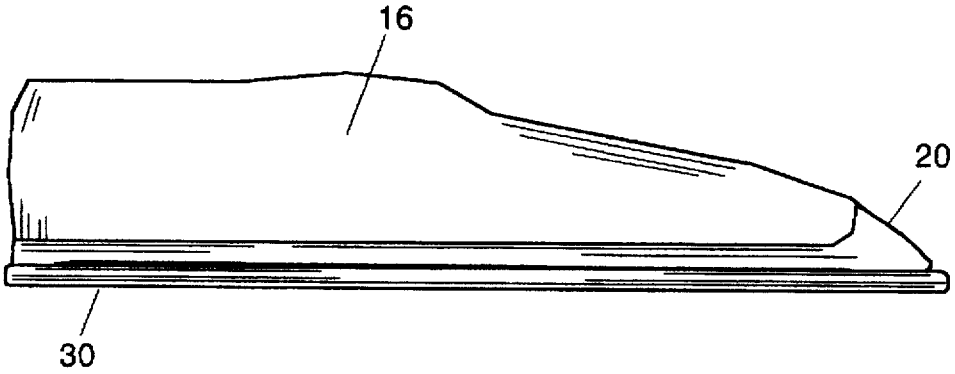
FIG. 4*b* is an inside elevational view thereof.
Figure 5A:
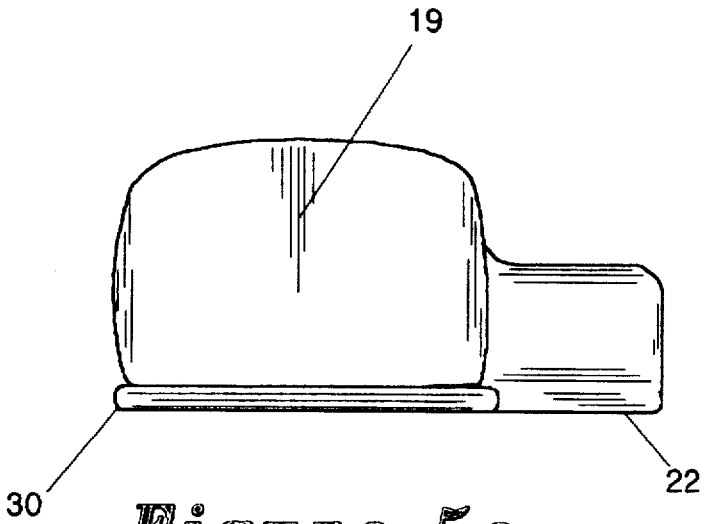
FIG. 5*a* is a rear elevational view thereof.
Figure 5B:
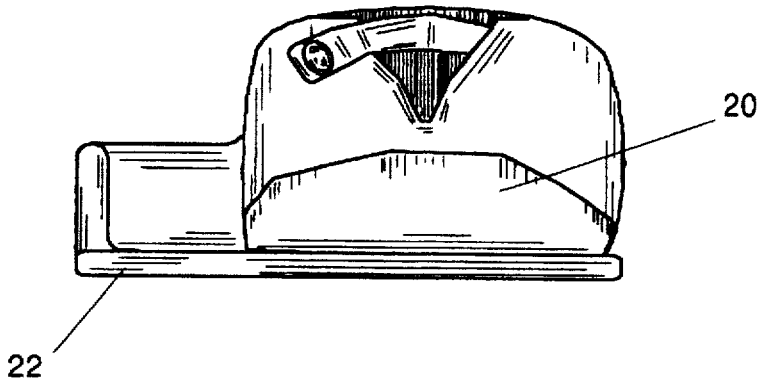
FIG. 5*b* is a front elevational view thereof.

The best mode for carrying out the invention is presented in terms of its preferred embodiment, herein shown in the Figures, wherein a pair of water shoes 10 are depicted. Each shoe 10 is formed by a lower sole 30 having a slip resistant lower surface 32. The sole 30 is affixed to a shoe upper body 12 formed of mesh material allowing for quick water drainage from the inner foot receiving cavity 14 formed between the sole 30 and upper body 12. The inner foot receiving cavity 14 is further formed in an otherwise conventional manner in that it is bounded by an inner shoe sidewall 16, an outer shoe sidewall 18, and a heel fence 19. A toe fence 20 is formed at the front edge of the shoe 10, either within the upper body 12 or by an upward projection of the sole 30. A foot attachment means 21 can optionally be provided of a conventional type. It is envisioned that straps, cords, snaps, ties, or the like can be used depending upon various styling preferences.

Extending from the sole 30 outward from the outer shoe sidewall 18 is a swim fin 22. The swim fin 22 extends laterally outward from the outer shoe sidewall 18, and does not extend forward beyond the toe fence 20 of the shoe 10. The swim fin 22 tapers laterally inward toward the shoe sidewall 18 at the heel 19, and has a semi-rigid outer fin edge 24. The outer fin edge 24 is fairly stiff and thick at the heel portion 24*a*, and tapers in thickness and becomes progressively more flexible toward the toe portion 24*b*. A fin area 26 is formed between the outer fin edge 24 and the shoe outer sidewall 18. This fin area 26 forms a water flow channel between the outer fin edge 24 and outer shoe sidewall 18 to allow for improved water drainage away from the shoe 5.

2. Operation of the Preferred Embodiment

To use the present invention, a user merely places the combination water shoe and swimmer's fin on the user's feet as with either conventional water shoes or as with conventional swimmer's fins. Foot protection is provided on land without interference with step or stride. In the water, additional swimming assistance is immediately provided.

The foregoing description is included to illustrate the operation of the preferred embodiment and is not meant to limit the scope of the invention. The scope of the invention is to be limited only by the following claims.

What is claimed is:

1. A water shoe comprising:

a lower sole having a slip resistant lower surface;

a shoe upper body affixed to said lower sole and formed of mesh material allowing for quick water drainage;

an inner foot receiving cavity formed between said sole and said upper body in an otherwise conventional manner such that it is bounded by an inner shoe sidewall, an outer shoe sidewall, and a heel fence, and a toe fence formed at the front edge of the shoe; and a swim fin extending laterally outward from the sole outward from the outer shoe sidewall.

2. The water shoe as described in claim 1, wherein said swim fin extends laterally outward from the outer shoe sidewall and does not extend forward beyond the toe fence of the shoe.

3. The water shoe as described in claim 1, wherein said swim fin further tapers laterally inward toward the shoe sidewall at the heel.

4. The water shoe as described in claim 1, wherein said swim fin further comprises:

a semi-rigid outer fin edge having a heel portion and a toe portion; and a fin area formed between the outer fin edge and the shoe outer sidewall, and wherein said fin area forms a water flow channel between the outer fin edge and outer shoe sidewall.

5. The water shoe as described in claim 4, wherein said outer fin edge is stiff and thick at the heel portion and tapers in thickness and becomes progressively more flexible toward the toe portion.

6. The water shoe as described in claim 1, wherein said toe fence is formed within said upper body.

7. The water shoe as described in claim 1, wherein said toe fence is formed by an upward projection of said sole.

8. The water shoe as described in claim 1, further comprising:

foot attachment means for securing said shoe onto a user's foot.

9. The water shoe as described in claim 8, wherein said foot attachment means includes a member of the group comprising straps, cords, snaps, and ties.

* * * * *